United States Patent [19]

Chittenden

[11] 4,261,115

[45] Apr. 14, 1981

[54] SNOWPLOW

[76] Inventor: Gordon D. Chittenden, 15736-138th St., Spring Lake, Mich. 49456

[21] Appl. No.: 68,871

[22] Filed: Aug. 22, 1979

[51] Int. Cl.[3] ..... E01H 5/04

[52] U.S. Cl. ..... 37/42 VL; 172/199; 172/787

[58] Field of Search ..... 37/42 R, 42 VL, 41, 37/50, DIG. 3; 172/136, 199, 197, 784, 786, 787, 801-806

[56] References Cited

U.S. PATENT DOCUMENTS

| | | | |
|---|---|---|---|
| 1,144,763 | 6/1915 | Heinen | 37/42 R |
| 1,856,148 | 5/1932 | Ball | 172/136 |
| 2,055,291 | 9/1936 | Henry | 37/42 |
| 2,061,585 | 11/1936 | Meyer | 37/42 R |
| 2,433,019 | 12/1947 | Arps | 172/136 X |
| 2,774,155 | 12/1956 | Hipp | 172/136 X |
| 2,899,760 | 8/1959 | Armington et al. | 172/136 X |
| 3,213,554 | 10/1965 | Dalton | 172/136 |
| 3,311,175 | 3/1967 | Richey | 172/136 |
| 3,793,752 | 2/1974 | Snyder | 37/42 R |
| 4,008,771 | 2/1977 | Tomio | 172/806 |

*Primary Examiner*—E. H. Eickholt

*Attorney, Agent, or Firm*—Price, Heneveld, Huizenga & Cooper

[57] ABSTRACT

A snowplowing blade includes a reverse scraping blade pivotally mounted to the rear surface of a conventional plow blade and supported such that when the conventional blade is lowered and moving in a reverse direction, the scraping blade is held in a stationary position at an obtuse angle with respect to a surface for removing snow from normally inaccessible areas such as the front of garage doors. When the conventional blade is moved in a forward direction during normal plowing, the reverse scraping blade pivots out of the way so as not to interfere with normal plow operation.

6 Claims, 2 Drawing Figures

SNOWPLOW

BACKGROUND OF THE INVENTION

The present invention relates to snowplows and particularly to an improved plow including a pivoted reverse scraping blade.

When removing snow from driveways and the like, it is frequently difficult to gain access to areas immediately adjacent garage doors where not infrequently winds cause drifting to occur. Conventional snowplow blades typically are concavely curved so as to effectively remove snow when moving in a forward direction. When the blade is lowered and the vehicle to which it is attached is moved in a reverse direction, the blade is wholly ineffectual in removing snow due to the curvature of the blade and the fact that it lifts up over the snow behind it. Thus, conventional blades cannot be used to reverse scrape snow from adjacent buildings.

One solution to this problem has been to use a separate blade attached to the rear of a snowplowing vehicle such as a pickup truck which can back up to the garage door, lower the rear blade, and pull the snow away from the garage such that it can then be removed by the normal front mounted snowplow blade. The addition of a separate blade and its associated hydraulic control system, however, is very costly to the snowplow operator.

The prior art discloses several plow blades which include lower scraper elements which are pivotally or flexibly mounted to the blade. Representative of such prior art are U.S. Pat. Nos. 2,055,291; 2,061,585; 2,337,434 and 3,793,752. The purpose of the movable scraper element in such prior art is to provide a movable plow element in the event the plow strikes an immovable object when traveling in a forward direction during plowing. U.S. Pat. Nos. 3,044,916; 3,483,643 and 4,008,771 disclose plows or scrapers which can be employed in a pulling direction. The construction and operation of these systems, however, is wholly different than that of the present invention.

SUMMARY OF THE INVENTION

The present invention provides a relatively inexpensive solution to the problem of snow removal near buildings by providing a scraping plate movably mounted to the rear surface of a conventional snowplow blade and means for holding the scraping plate at an obtuse angle to the surface when the snowplow is moving in a reverse direction such that it is effective in pulling snow away from a building. When the plowing vehicle is moving in a forward direction, however, the plate moves out of the way so as not to interfere with normal plowing operation.

Snowplows embodying the present invention include a longitudinally extending scraper plate, means for movably mounting the scraper plate to the rear surface of a conventional snowplow along the lower portion thereof, and means extending between the conventional blade and the scraping plate for holding the scraping plate at an obtuse angle with respect to the surface being plowed when the plowing vehicle is moving in a reverse direction. In the preferred embodiment, the scraper plate or blade has a height such that it extends, when in an operative snow removing position, slightly below the edge of the conventional plow to which it is secured so as to be the only operative scraping surface when the vehicle is moving in reverse. These and other objects, features and advantages of the present invention will become apparent upon reading the following description thereof together with reference to the drawings in which:

DETAILED DESCRIPTION OF THE PREFERRED EMBODIMENT

Figure 1:
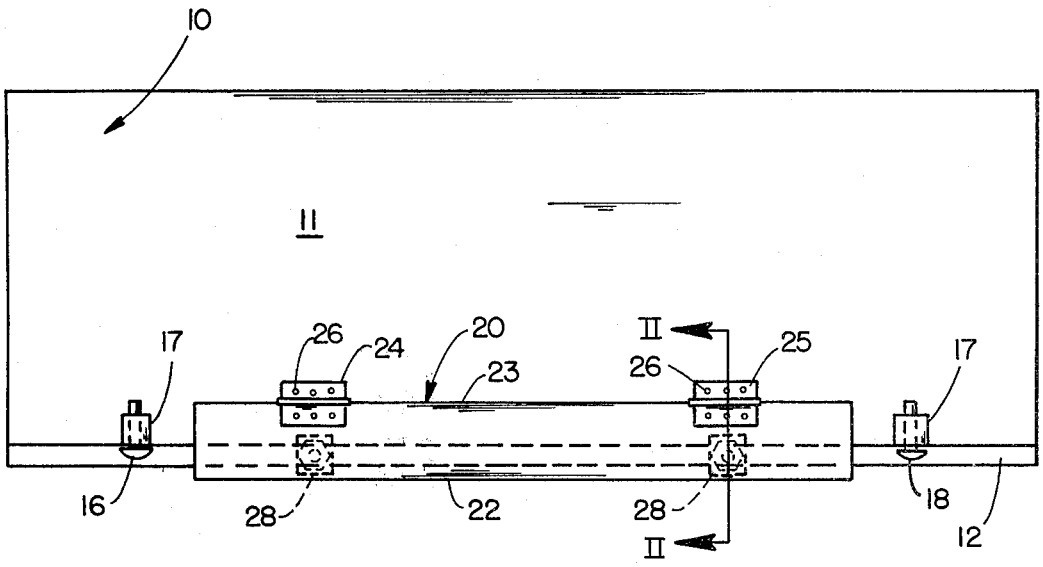
FIG. 1 is a rear, elevational view of a snowplow embodying the present invention.

Referring initially to FIG. 1 there is shown a conventional concavely curved plow blade 10 which can be used for snow removal or for movement of other material along a surface. Blade 10 is attached to a plowing vehicle such as a pickup truck by conventional support and attachment means (not shown) such as commercially available Meyer plow equipment. Such attachment means includes a frame welded at one end to the rear surface 11 of blade 10 and having its opposite end pivotally secured to the plowing vehicle. Typically, hydraulic cylinders are employed for raising and lowering the blade as well as tilting it from left to right.

The blade 10 conventionally includes a wear plate 12 extending along its lower edge and secured thereto by a plurality of bolts 14 spaced at intervals along the longitudinally extending blade. Plate 12 typically is made of a wear resistant material such as hardened steel. Also, conventionally secured to the blade 10 is a pair of adjustment pads 16 and 18 spaced inwardly from opposite ends thereof and threadably secured to mounting bosses 17 welded to the rear surface 11 of the blade as shown in FIG. 1.

Figure 2:
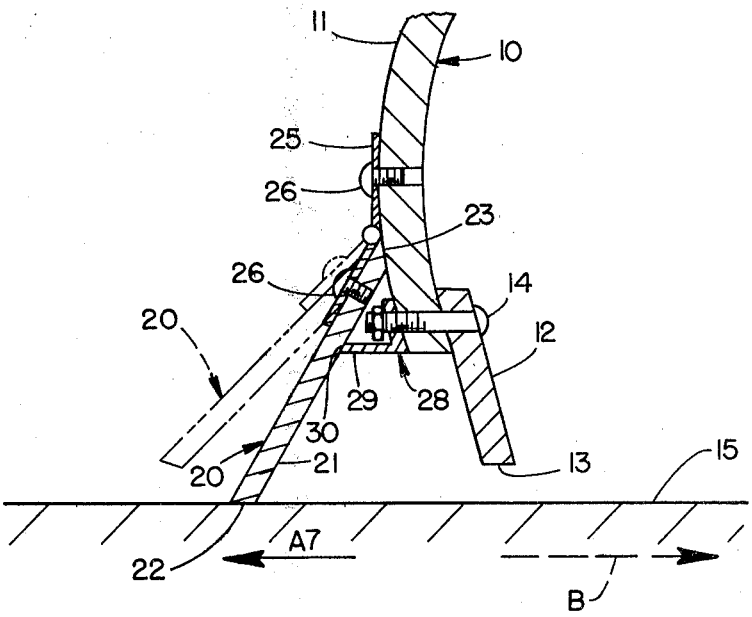
FIG. 2 is a fragmentary, cross-sectional view taken along the sections lines II—II of FIG. 1 shown partly in phantom form.

Pivotally or otherwise movably mounted to the rear surface 11 of blade 10 is a reverse scraping blade 20 of the present invention made in the preferred embodiment of a one-half inch thick rectangular steel plate having a lower surface contacting edge 22 cut at an angle with respect to the plate so as to be parallel with the surface of the ground 15 when the blade is in an operative position as shown in the solid lines in FIG. 2. The opposite end 23 of blade 20 similarly is cut at an angle so as to engage the rear surface 11 of blade 10 for additional support. Plate 20 is pivotally secured to the rear surface 11 of blade 10 by a pair of hinges 24 and 25 by means of bolts 26 such that the blade can swing upwardly as shown in phantom form in FIG. 2 when blade 10 is moving forwardly in a snowplowing direction as indicated by arrow B in FIG. 2.

Support means 28 comprising a pair of L-shaped brackets in the preferred embodiment are also spaced inwardly from the ends of plate 20 and are provided to engage front surface 21 of plate 20 to hold the plate in the operative position in a predetermined relationship with regard to the blade 10 and ground 15 as shown in FIG. 2 when the snowplowing vehicle is moving in a reverse direction as indicated by arrow A in the Figure. Brackets 28 are bolted to the lower edge of blade 10 by bolts 14 as best seen in FIG. 2 and include a horizontally and rearwardly extending leg 29 which has an angled edge 30 engaging front surface 21 of plate 20 as also seen in FIG. 2. The height and positioning of blade 20 is selected such that edge 22 extends slightly below the lower edge 13 of wear plate 12 of the conventional blade when in the operative position shown in FIG. 2 such that the reverse scraping blade or plate 20 is the only member contacting the ground when the snowplow is moved in a reverse direction. In the preferred embodiment, plate 20 had a height of 6 inches and extended approximately three-fourths of an inch below plate 12. The obtuse angle (FIG. 2) at which plate 20 intersects the ground is approximately 120° in the preferred embodiment.

In operation, when the snowplowing vehicle is moving forwardly, plate 20 pivots upwardly as shown in phanton form in FIG. 2 and does not affect the normal snowplowing action. When however, it is desired to remove snow from a building or the like, the operator moves the vehicle with the blade 10 raised in an elevated position to a position adjacent the garage door, for example, then lowers the blade until the edge 13 of the normal blade contacts the surface. As the vehicle moves in reverse, edge 22 of the scraper blade 20 will pivot downwardly into the operative position as shown in FIG. 2 partly due to the weight of plate 20 itself and partly due to the frictional contact of edge 22 with the ground which when the plate is moved in the direction of arrow A, rotates the plate to the operative position, thus, raises blade 10 slightly and captures the snow immediately adjacent and behind the blade 10 and plate 20 for drawing the snow away from the building. Naturally, if it is desired to reverse the vehicle without the pulling action of the snow or other material, blade 10 can simply be raised by the vehicle operator to render scraper blade 20 ineffective. Thus, in the system of the present invention a relatively inexpensive and yet effective means is provided for moving snow or other materials from closely adjacent a building without interferring with normal operation of the snowplow. As seen in FIG. 1, the width of plate 20 is less than blade 10 in the preferred embodiment although it is to be understood that the width of the plate can be extended or reduced. Naturally, the system of the present invention can be marketed separately as an attachment kit for conventional snowplows or sold as original equipment with the blade.

Various modifications to the present invention can be made, thus, for example, blade 20 can be slideably mounted to blade 10 with suitable actuators or can be pivoted hydraulically although the weight of the blade itself will render it effective as described above. Other modifications such as utilization of more hinges, or a continuous piano-type hinge and/or different types of support means extending between the conventional blade and the reverse scraping blade will become apparent to those skilled in the art. These and various other modifications will, however, fall within thespirit and scope of the invention as defined by the appended claims.

The embodiments of the invention in which an exclusive property or privilege is claimed are defined as follows:

1. An attachment for use with a conventional plow such that the plow can be employed to pull material in a direction opposite normal plowing, said attachment comprising:

a plate having forward and rearward facing surfaces and opposite edges communicating with said forward and rearward surfaces, said edges tapered outwardly from said forward to said rearward surface and wherein said edges include a lower edge for communicating with the ground and upper edge adapted to abut against a rear surface of the plow for support;

means for movably attaching said plate to the plow for movement between a first operative position whereupon said lower edge engages the ground and said upper edge engages the rear surface of the plow and a second inoperative position whereupon said lower edge is raised away from the ground; and means for holding said plate in predetermined relationship with respect to the ground when in said inoperative position.

2. The apparatus as defined in claim 1 wherein said means for movably attaching said plate to the plow comprises hinge means pivotally secured to said plate near said upper edge and adapted to be secured to the plow permitting pivotal motion of said plate between said operative and inoperative positions such that said lower edge extends below the lower edge of the plow when said plate is in said operative position.

3. The apparatus as defined in claim 2 wherein said means for holding said plate comprises block means extending between said forward facing surface of said plate and the plow for holding said plate at an obtuse angle with respect to the ground when said plate is in the operative position.

4. A plow for use in pushing material in a normal plowing direction and for pulling material in a direction opposite the normal plowing direction comprising:

a plow blade;

a plate having forward and rearward facing surfaces and opposite edges communicating with said forward and rearward surfaces, said edges tapered outwardly from said forward to said rearward surface and wherein said edges include a lower edge for communicating with the ground and an upper edge adapted to abut against a rear surface of said plow blade for support;

means for movably attaching said plate to said plow blade for movement between a first operative position whereupon said lower edge engages the ground and said upper edge engages the rear surface of said plow blade and a second inoperative position whereupon said lower edge is raised away from the ground; and means for holding said plate in predetermined relationship with respect to the ground when in said inoperative position.

5. The apparatus as defined in claim 4 wherein said means for movably attaching said plate to said plow blade comprises hinge means pivotally secured to said plate near said upper edge and adapted to be secured to said plow blade permitting pivotal motion of said plate between said operative and inoperative positions such that said lower edge extends below the lower edge of said plow blade when said plate is in said operative position.

6. The apparatus as defined in claim 5 wherein said means for holding said plate comprises block means extending between said forward facing surface of said plate and said plow blade for holding said plate at an obtuse angle with respect to the ground when said plate is in the operative position.

* * * * *